United States Patent [19]

Oake

[11] Patent Number: 4,552,362

[45] Date of Patent: Nov. 12, 1985

[54] GAME TABLE WITH MULTIPLE PLAYING SURFACES

[76] Inventor: Hugh F. Oake, 1607 S. Mullen St., Tacoma, Wash. 98405

[21] Appl. No.: 577,254

[22] Filed: Feb. 6, 1984

[51] Int. Cl.[3] ..... A63F 3/00

[52] U.S. Cl. ..... 273/237; 273/280; 273/284; 273/287; 273/309; 108/6; 108/62; 108/50

[58] Field of Search ..... 108/6, 50, 62; 273/237, 273/280, 284, 286, 287, 309

[56] References Cited

U.S. PATENT DOCUMENTS

| | | | |
|---|---|---|---|
| 139,425 | 5/1873 | Schindler | 273/280 |
| 148,174 | 3/1874 | Buckley | 273/280 |
| 178,267 | 6/1876 | Buckley et al. | 273/284 |
| 352,555 | 11/1886 | Merkel | 108/62 |
| 522,014 | 6/1894 | Hunzinger | 108/62 |
| 1,353,728 | 9/1920 | Dence | 108/62 |
| 2,248,276 | 7/1941 | Le Tourneau | 108/62 |
| 3,152,806 | 10/1964 | Jackman | 273/286 |
| 3,359,003 | 12/1967 | Kass | 273/241 |
| 3,909,000 | 9/1975 | Akers | 273/239 |
| 4,330,776 | 5/1982 | Dennison | 400/78 |

FOREIGN PATENT DOCUMENTS

| | | | |
|---|---|---|---|
| 762627 | of 1927 | Australia | 108/62 |
| 2335178 | 7/1977 | France | 273/287 |
| 524625 | 8/1940 | United Kingdom | 108/6 |

*Primary Examiner*—Richard C. Pinkham
*Assistant Examiner*—Benjamin Layno
*Attorney, Agent, or Firm*—Graybeal & Cullom

[57] ABSTRACT

Furniture quality game table with multiple plane surfaces on at least three sides of a cubical game board assembly, with end panels journaled for rotation on end standards spanning the board assembly, and with endwise removable locking pins and a handle for locking the board assembly with any one of the game board surfaces in an upper horizontal position, with the handle configured to cover the locking pins from view when engaged. The typical game board assembly is rotatable on a fixed trunnion bar on which a lighting fixture is mounted for back lighting of the game board surfaces. The table includes in its lower portion a storage compartment for game pieces, playing cards and the like.

10 Claims, 6 Drawing Figures

Fig. 5.
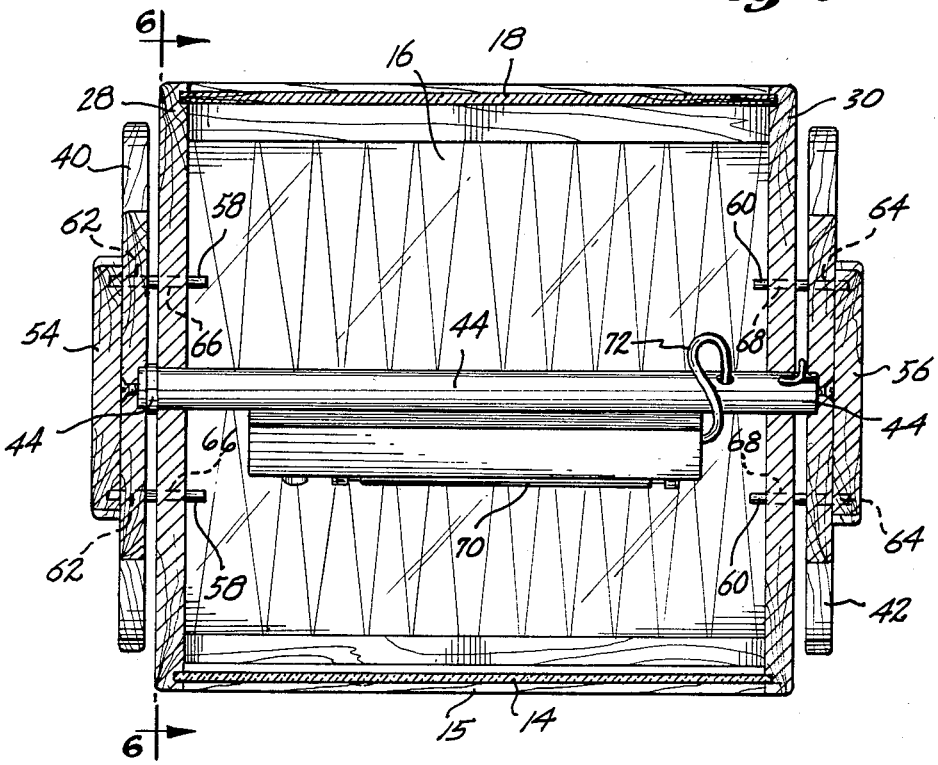
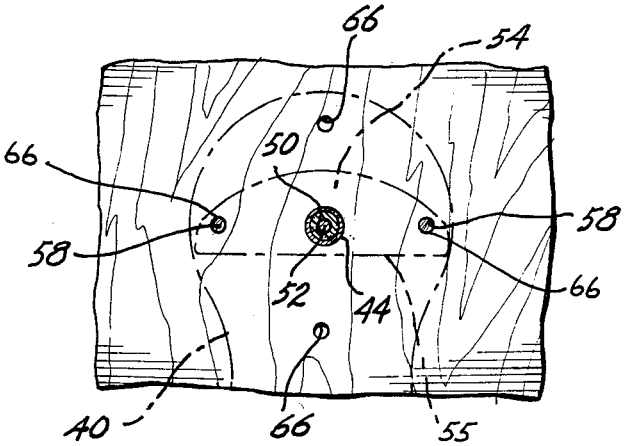
Fig. 6.

GAME TABLE WITH MULTIPLE PLAYING SURFACES

BACKGROUND OF THE INVENTION

1. Field of the Invention

This invention relates to a multiple surface game table, and more particularly to a game table wherein any selected one of several playing surfaces available on the sides of a cubical board assembly may be arranged in an upper horizontal position and locked in such a position for use in the playing of the selected game.

2. Description of the Prior Art

Plural playing surface game tables with rotatably reversible top surfaces are known in general, such as disclosed in Schindler U.S. Pat. No. 139,425 and Buckley U.S. Pat. No. 148,174. In the games tables disclosed in these patents, two reversible top surfaces are available, each carrying a different game board, and with threaded type locking means being provided between the ends of the game board assembly and upright supporting arms or posts. In such table arrangements, only two types of game playing surfaces are available and the game surfaces are not and cannot be back lighted by reason of the nature of the board construction and the mounting thereof. Both of the tables disclosed in these old patents are also of a type where the game board assembly is supported on a single post pedestal, making them relatively unattractive from an esthetic point of view, and not a true article of furniture in the sense of being compatible with other articles of furniture in a contemporary living room or like setting.

There is also known a small six-sided cube, having a different game board on each side of the cube, such as shown in a Spencer catalog bearing a USPTO received date of Aug. 21, 1973, at page 18 (in subclass 273/287).

Also of general interest are Buckley et al U.S. Pat. No. 178,267, Hunzinger U.S. Pat. No. 522,014 and Kass U.S. Pat. No. 3,359,003.

SUMMARY OF THE INVENTION

The present invention provides a free-standing, multiple playing surface game table wherein the game board assembly is in cubical form, including four side panels, each with a different game playing surface, with each surface being rotatable to an upper horizontal position and lockable in such position by lock means including lock pins insertable through one or both end panels of the game board assembly and through one or both support standards spanning the board assembly, such pin type lock means being mounted on one or both of the handles for ease of manipulation thereof and for ease of carrying or moving of the table from place to place.

Rotation of the cubical game board assembly for movement of a selected one of the several game board surfaces to an upper horizontal position is by arrangement of the cubical game board assembly to be rotatably supported on a trunnion bar extending between and supported by end standards, the end panels having centrally placed bearing means engaging the trunnion bar. In preferred form, the trunnion bar is tubular in nature and in fixed position on the end standards, with at least some of the game board surfaces of the table are at least in part clear or transluscent in nature, and with fixed illumination means mounted within the cubical game board assembly so as to provide back illumination of the playing surfaces, the electrical wiring for the illumination means being advantageously led interiorly of one end of the tubular trunnion bar and thus out of the rotatable cubical game board assembly without impeding or limiting the extent of rotation of the game board assembly or complicating the wiring to the illumination means.

A further feature of the game table characteristic of the invention is a provision of a general box-like overall configuration simulating a conventional end table or the like with two fixed end standards spanning the cubical game board assembly, and with a storage compartment below the game board assembly and between the lower portion of the end standards.

BRIEF DESCRIPTION OF THE DRAWINGS

Other features and advantages of the multiple playing surface game table of the present invention will be apparent from the following description of a typical embodiment thereof and the accompanying drawings illustrating same, wherein:

FIG. 5 is a cross-sectional view of the game table shown in FIG. 1, taken in a horizontal plane slightly above the trunnion bar, i.e. taken substantially along line 5—5 of FIG. 2; and FIG. 6 is a detail plan view of one of the end panels of the cubical game board assembly, taken substantially along line 6—6 of FIG. 5 and also showing portions of the associated end standard and handle in phantom, showing the hole pattern in the end panel enabling the locking of the cubical game board assembly in any selected one of its use positions by means of placement of the pins of the locking handle in aligned holes in the end standard and in the game board assembly end panel.

DESCRIPTION OF THE PREFERRED EMBODIMENT

Figure 1:
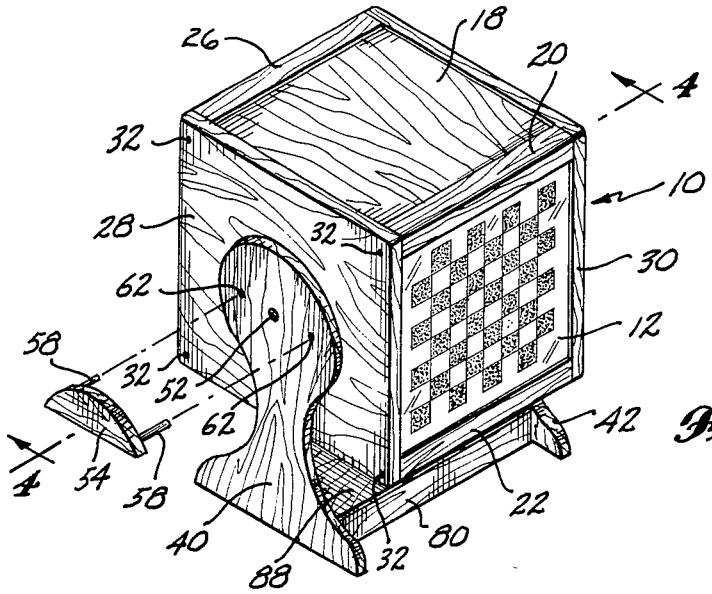
FIG. 1 is an isometric view from an upper aspect of the game table, with the cubical game board assembly in a position with a playing surface at the top and a checker/chess board on the vertical surface in view, and with one locking handle thereof shown in exploded view.

The typical embodiment of the table, as shown in the accompanying drawings, comprises a game board assembly generally indicated at 10, made up of four side panels 12, 14, 16, 18, with panel 12 bearing a checker/chess board pattern, panel 14 bearing a cribbage board pattern 15 in its central portion, panel 16 bearing a backgammon game pattern, and panel 18 having a plain wood grain surface for use as a non-patterned playing surface or conventional table top, for example. Because of the back lighting feature of the table, discussed in more detail below, the panels 12, 14, 16 are fabricated of clear or transluscent plastic or glass so they may be illuminated in appearance during play, if desired, by light emerging from the openings or gaps in the game pattern thereon.

The respective panels 12, 14, 16, 18 are framed by respective corner members 20, 22, 24, 26, and by end panels 28, 30, the end panels 28, 30 being affixed to the corner members 20, 22, 24, 26 as by screws, certain of which are indicated at 32, or by adhesive bonding, to form a rigid cubical structure.

Figure 4:
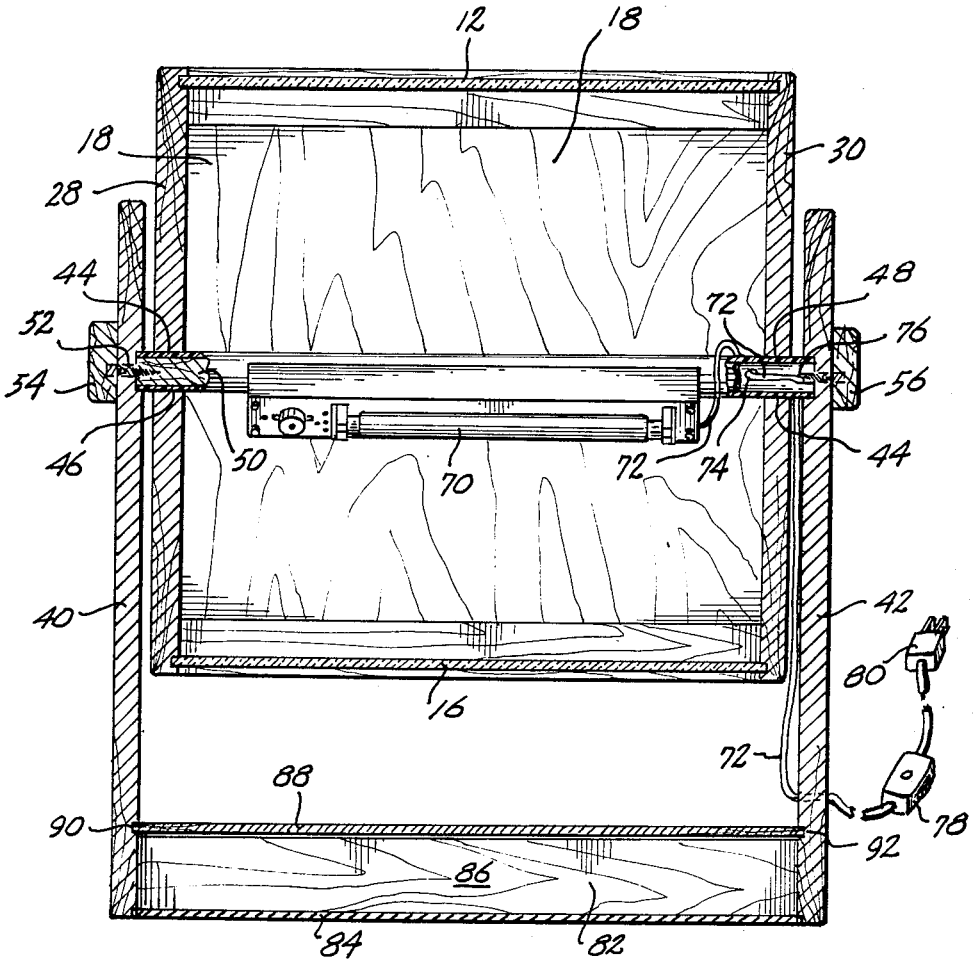
FIG. 4 is a cross sectional view taken in a vertical plane substantially bisecting the table, i.e. taken substantially along line 4—4 of FIG. 1, with the end portions of the trunnion bar shown in section and the central portion and its attached illumination means shown in elevation.

End standards 40, 42 span the game board assembly 10 and rigidly support therebetween a tubular trunnion bar 44, arranged centrally through the cubical game board assembly, with respective holes 46, 48 (FIG. 4) being provided centrally in the end panels 28, 30, said holes 46, 48 providing bearing or journal surfaces for rotation of the cubical game board assembly 10 on the trunnion bar 44. For anchoring in fixed position, one end of the tubular bar 44 is fitted with a wooden plug 50 and rigidly affixed to the end panel 40 by means of screw 52. Two locking handles 54, 56, each identical with the other, and each comprising respective locking pins 58, 60 are provided to present convenient lifting means for moving of the table from place to place and to lock the game board assembly 10 with any selected one of its playing surfaces 12, 14, 16, 18 in an upward horizontal position, such locking action being by lengthwise movement of the respective pins 58, 60 through respective holes 62, 64 in the end panels 40, 42 and through selective respective holes 66, 68 in the cube end panels 28, 30.

With the handles 54, 56 withdrawn in directions parallel to the axis of rotation of the cubical game board assembly, which axis of rotation is concentric with the axial center of trunnion bar 44, the game board assembly 10 is rotatable on the trunnion bar 44, and when the pins 58, 60 are engaged in respective holes 62, 64 and selected pairs of holes 66, 68, the game board assembly 10 is locked against rotation with respect to the end standards 40, 42.

Figure 3:
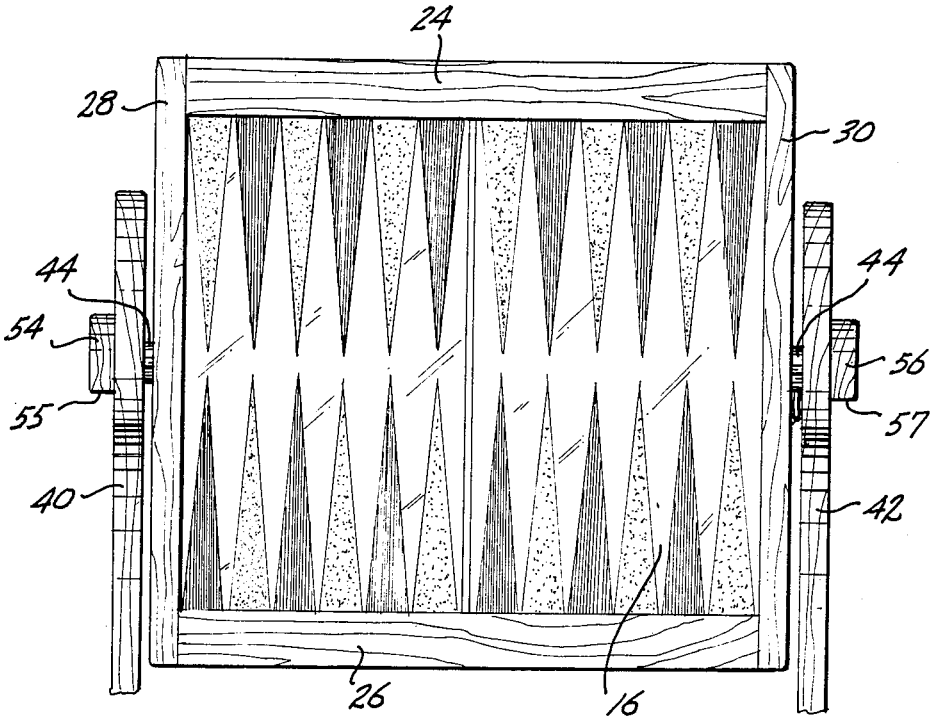
FIG. 3 is a further side elevational view of the table shown in FIG. 1, with the game playing surface shown being of the backgammon game board type, and with the locking handles of the assembly in place.

Handles 54, 56 are suitably configured to have flat, horizontal lower surfaces 55, 57 (FIG. 3), so as to be easily engageable by the fingers of a user in lifting and moving the game table from one location to another.

For back lighting of the game boards, a suitable illumination means such as a conventional electric light, for example fluorescent light assembly 70, is mounted interiorly of the cube, suitably on trunnion bar 44 (FIG. 4), with the power cord 72 for such assembly being led through a hole 74 in the tubular bar 44 and internally of such bar 44 to an exit hole 76 externally of the cube. The cord 72 comprises a conventional off-on switch 78 and power plug 80. By virtue of the cord 72 being led internally through the trunnion bar 44 at one end thereof, the cord 72 presents no impediment to or interference with the rotatability of the game board assembly 10.

Figure 2:
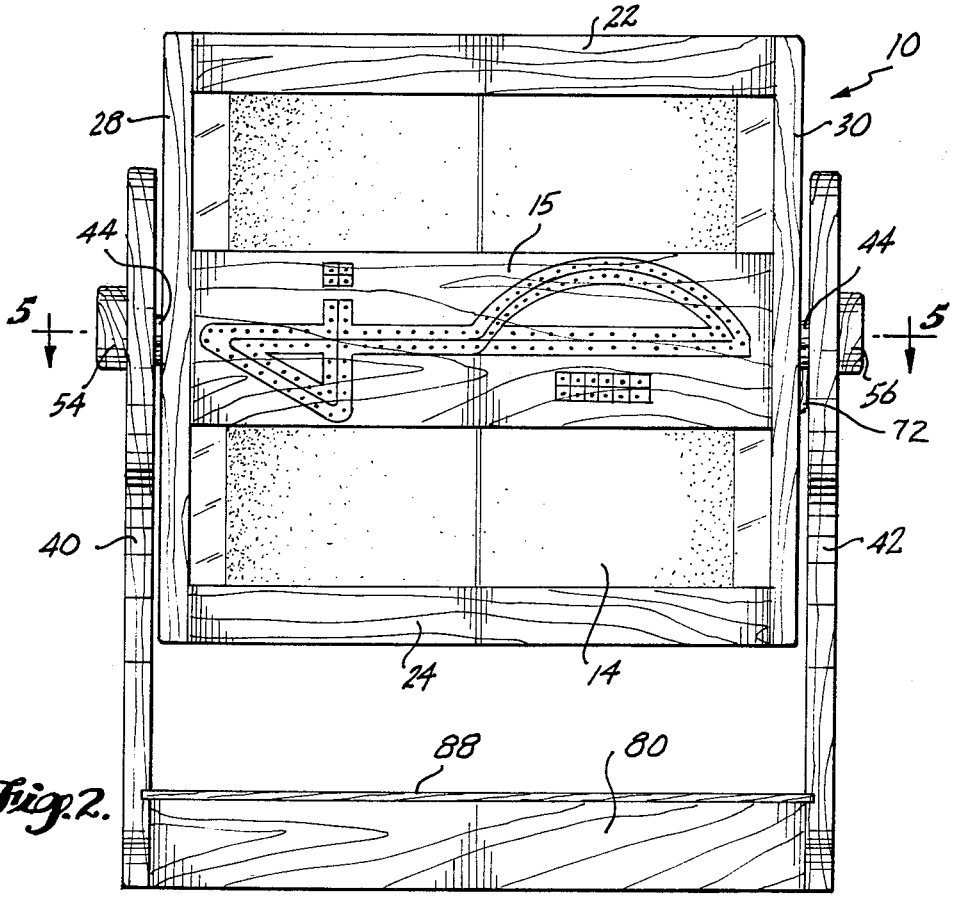
FIG. 2 is a side elevational view of the table shown in FIG. 1, on an enlarged scale and with its cribbage board playing surface in view, the locking handles being removed in this view so that the cubical game board assembly is rotatable on the end standards.

As will be evident in the drawings, end standards 40, 42 are rigidly joined by screws (not shown) or adhesive bonding to spaced, parallel cross members 80, 82 in the lower portions thereof to form a rigid base for the end standards. A bottom panel 84 encloses the bottom edges of the end standards 40, 42 and cross members 80, 82, and provides a game paraphernalia storage compartment 86. Top panel 88 encloses the compartment 86 and is suitably openable by being slid horizontally slidable in horizontal grooving 90, 92 in the respective end standards 40, 42 (FIGS. 2 and 5).

In that insertion of either lock pins 58 or lock pins 60 through the aligned holes in the respective associated end standard 40 or 42 and cube end panel 28 or 30 will serve to lock the cube 10 against rotation, it is self-evident that only unit 54 and its pins 58 (or handle unit 56 and its pins 60) is necessary for the locking function, in which event the other handle can be fixedly mounted on its end panel and its pins and associated holes dispensed with. Also evident is the fact that utilization of but a single pin on each handle, or of a single pin on but one of the handles, is adequate for the locking function. However, construction of the handles and pins as shown is preferred, for symmetry, in that the table and its components are otherwise symmetrical end for end.

From the foregoing, various modifications, adaptations and alternative or additional features and arrangements will be apparent to those skilled in the art to which the invention is addressed, within the scope of the following claims.

What is claimed is:

1. A multiple playing surface game table having the appearance of a piece of furniture, comprising:

a rigid base including two parallel upright end standards, a trunnion bar extending between and supported by said end standards, a generally cubical game board assembly including two end panels and four side panels, said two end panels including bearing means supporting said assembly for rotation on said trunnion bar between the base end standards, said side panels comprising at least three different game board surfaces, and lock means for engaging and preventing relative rotation between at least one of the end standards and the adjacent end panel of the cubical assembly, said lock means including:

a hole through one of the end standards, a hole in the end panel of the cubical assembly adjacent said end standard, arranged so that the adjacent said end standard covers said end panel hole from view at all times, and a pin means removably insertable through said end standard hole into said end panel hole, the pin means when so inserted locking the cubical assembly against rotation relative to the end standard with any one of the assembly side panels in an upper horizontal position, said pin means being arranged on and being manipulated by handle means covering said end standard hole from view when said handle means is engaged, said handle means also providing a grip surface exteriorly of the end standard for manual engagement by a user in lifting and moving the game table.

2. The game table according to claim 1, wherein the game board surfaces on said side panels include a checker/chess board, a cribbage board, and a backgammon board.

3. A game table according to claim 1, wherein said trunnion bar is fixedly mounted with respect to said end standards, and said table further comprises electric light means stationarily mounted interiorly of the game board assembly, the wiring to said light means being led out interiorly of said trunnion bar at one end thereof.

4. A game table according to claim 1, wherein said base comprises an enclosed, box-like structure extending between the lower portions of said end standards and below the cubical assembly, said box-like structure serving as a storage compartment for game paraphernalia and the like.

5. A free-standing, multiple playing surface game table having the appearance of a piece of furniture, comprising:

a free-standing base including two parallel upright end standards, a trunnion bar extending between and supported by said end standards, a generally cubical game board assembly including two end panels and four side panels, said two end panels including bearing means centrally located in said end panels and engaging said trunnion bar for rotation of said board assembly thereon, said side panels comprising at least three different game board surfaces, a handle means having parallel pins, and at least one of said end standards being provided with holes for receiving said parallel pins of said handle means insertable therethrough, with the adjacent end panel of the cubical assembly also being provided with a pattern of holes arranged so that the adjacent end standard covers each hole of the end panel from view at all times and holes in the adjacent end panel are alignable with the pin holes in at least one of said end standards so that, with the pins of the handle means inserted through the pin holes in the end standard and through selected holes in the said end panel, any selected one of the cubical assembly side panels is locked in an upper horizontal position with respect to the end support, said handle means capable of covering said end support holes from view when said handle means is engaged.

6. The game table according to claim 5, wherein the game board surfaces on said side panels include a checker/chess board, a cribbage board, and a backgammon board.

7. A game table according to claim 6, wherein said trunnion bar is fixedly mounted with respect to said end standards, and said table further comprises electric light means stationarily mounted on said trunnion bar interiorly of the game board assembly, the power cord to said light means in part being arranged within said trunnion bar at one end thereof.

8. A game table according to claim 6, comprising two such handle means, each associated with a respective end panel and each comprising a grip surface positioned exteriorly of the associated end standard for engagement by the fingers of a user in lifting and moving the game table.

9. A game table according to claim 5, wherein said base comprises an enclosed, box-like structure extending between the lower portions of said end standards and below the cubical assembly, said box-like structure serving as a storage compartment for game paraphernalia and the like.

10. A multiple playing surface game table having the appearance of an article of furniture for a contemporary living room like setting, comprising:

a rigid base including two parallel upright end standards, a trunnion bar extending between and supported by said end standards, a generally cubical game board assembly including two end panels and four side panels, said two end panels including bearing means supporting said assembly for rotation on said trunnion bar between the base end standards, said side panels comprising at least three different game board surfaces, lock means for engaging and preventing relative rotation between at least one of the end standards and the adjacent end panel of the cubical assembly, and when so engaged locking any selected one of the cubical side panels in an upper horizontal position with respect to the base, including:

a hole through said end standard, a hole in the assembly end panel adjacent said end standard, arranged so that the adjacent end standard covers said end panel hole from view at all times, and pin means insertable through said end standard hole into said end panel hole, the pin means when so inserted locking the cubical assembly against rotation relative to the end standard with any one of the assembly side panels in an upper horizontal position, and handle means having said lock pin means arranged thereon and being capable of engagement with the end standard such that the lock pin means is inserted through the end standard hole into the end panel hole, said handle means also providing a grip surface exteriorly of the end standard for manual engagement by a user in lifting and moving the game table, said handle means being configured to cover said end standard holes from view when said handle means is engaged.

* * * * *